US005203476A

United States Patent [19]

Keller

[11] Patent Number: 5,203,476

[45] Date of Patent: Apr. 20, 1993

[54] ELECTRICALLY OPERATED DISPENSING APPLIANCE INCLUDING MECHANICAL MEANS FOR PREVENTING AFTERFLOW OF THE DISPENSED PRODUCT

[76] Inventor: Wilhelm A. Keller, Obstgartenweg 9, CH - 6402 Merlischachen, Switzerland

[21] Appl. No.: 719,235

[22] Filed: Jun. 21, 1991

[30] Foreign Application Priority Data

Jun. 22, 1990 [CH] Switzerland ..... 02090/90

[51] Int. Cl.[5] ..... B67D 5/52

[52] U.S. Cl. ..... 222/136; 222/145; 222/326; 222/333; 222/390

[58] Field of Search ..... 222/135, 136, 145, 325, 222/326, 333, 386, 390

[56] References Cited

U.S. PATENT DOCUMENTS

| | | | |
|---|---|---|---|
| 3,854,629 | 12/1974 | Blieberger | 222/109 |
| 3,985,273 | 10/1976 | Davis, Jr. | 222/386 X |
| 4,024,994 | 5/1977 | Davis, Jr. | 222/326 |
| 4,157,771 | 6/1979 | Smith | 222/390 X |
| 4,273,269 | 6/1981 | Davis, Jr. | 222/326 |
| 4,615,469 | 10/1986 | Kishi et al. | 222/327 |
| 4,826,053 | 5/1989 | Keller | 222/340 |
| 4,911,328 | 3/1990 | Keller | 222/47 |
| 5,002,737 | 3/1991 | Tervamaki | 222/386 X |
| 5,104,005 | 4/1992 | Schneider, Jr. et al. | 222/390 X |

FOREIGN PATENT DOCUMENTS

| | | | |
|---|---|---|---|
| 0054702 | 6/1982 | European Pat. Off. | 17/21 |
| 3400726 | 7/1985 | Fed. Rep. of Germany | 222/326 |
| 3535229 | 4/1987 | Fed. Rep. of Germany | 222/386 |
| 3811954 | 10/1989 | Fed. Rep. of Germany | 222/390 |

OTHER PUBLICATIONS

European Search Report dated Jan. 30, 1991.

*Primary Examiner*—Andres Kashnikow
*Assistant Examiner*—Joseph A. Kaufman
*Attorney, Agent, or Firm*—Ostrolenk, Faber, Gerb & Soffen

[57] ABSTRACT

The electric dispensing appliance is designed for a double cartridge and comprises a driving spindle which actuates the two thrust rods. In order to prevent an afterflow of the dispensed composition, the driving spindle is rotatably attached to a connecting piece which is longitudinally displaceable with respect to the housing. A double toggle articulation provides a reversible mechanical connection between the housing and the connecting piece, one lever being connected to the housing, a second lever to the connecting piece, and a third lever to the other ends of the first two levers and to the trigger lever of the appliance. The use of a simple mechanical device such as a toggle joint allows an effective suppression of any afterflow.

13 Claims, 2 Drawing Sheets

ELECTRICALLY OPERATED DISPENSING APPLIANCE INCLUDING MECHANICAL MEANS FOR PREVENTING AFTERFLOW OF THE DISPENSED PRODUCT

The present invention relates to an electrically operated dispensing appliance. Compared to a manually operated appliance, an electrically operated dispensing appliance has the advantage of requiring a reduced effort, particularly in the case of large cartridges, and compared to a pneumatically operated appliance, it has the advantage of an increased mobility if an accumulator or batteries are used.

In an electrically operated dispensing appliance, there is a risk that the cartrigde is distended to a certain degree, depending on the material, during the advance of the dispensing piston, so that the cartridge contracts as soon as the drive and thus the advancing pressure is stopped, with a resulting afterflow of the composition. It is therefore an object of the present invention to provide means in order to prevent an afterflow of the dispensed composition. This object is attained by means of a dispensing appliance wherein the electric drive acts upon at least one thrust rod for a cartridge via a driving spindle, and wherein a trigger lever acting upon the operating switch is connected to mechanical means which act upon said driving spindle in such a manner that said means relieve said thrust rod(s) when said pulled trigger lever is released, in order to prevent an afterflow of the dispensed composition. Further advantages and improvements of the dispensing appliance are disclosed in the description and in the appended claims.

The invention is explained in detail with reference to a drawing of an embodiment.

FIG. 1 snows a sectional view of a dispensing appliance according to the invention;

Figures 1, 2:
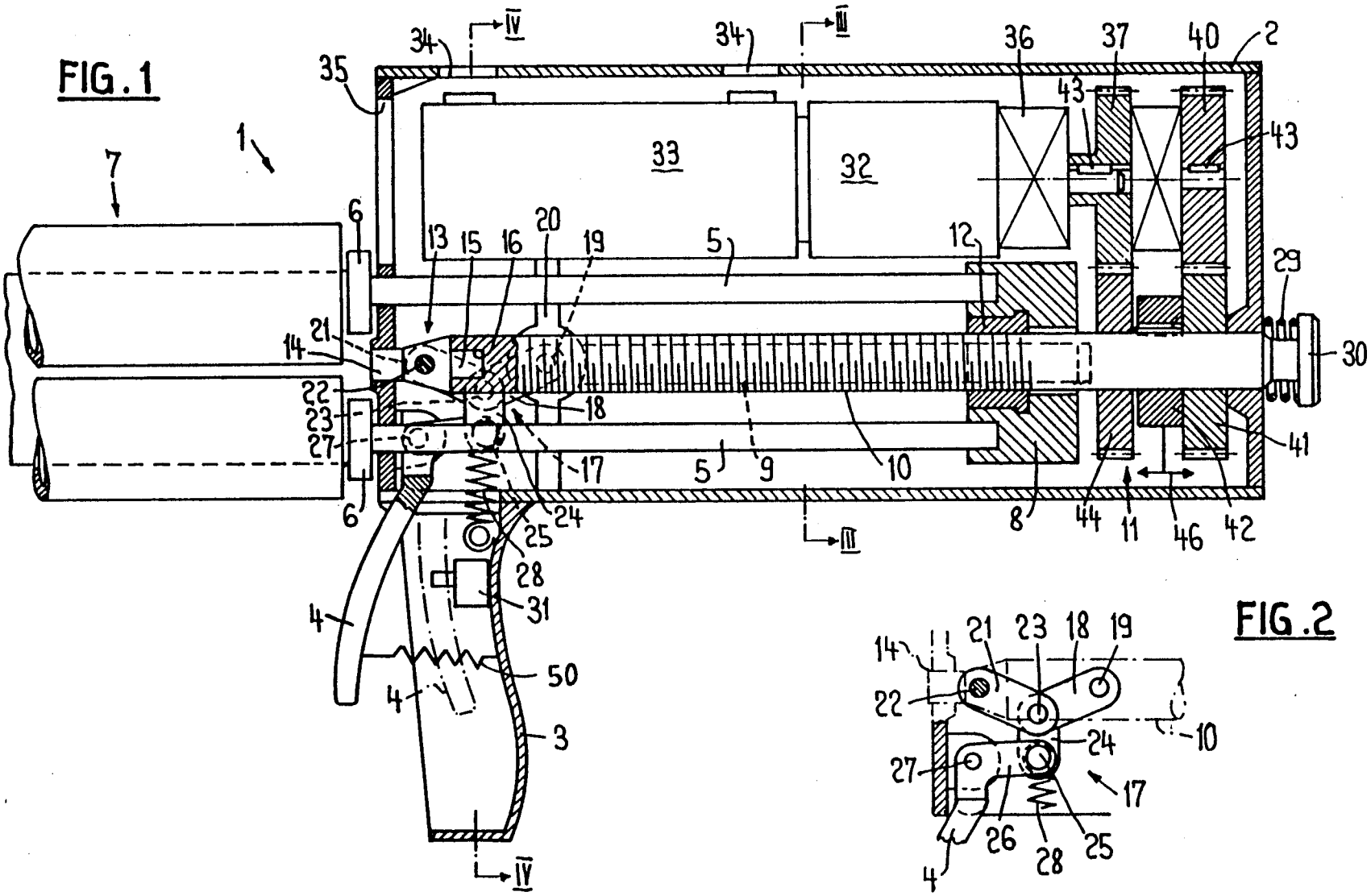
FIG. 2 shows a detail of FIG. 1.

The illustrated appliance 1 is an electric dispensing appliance for a double dispensing cartridge for two-component compositions. Appliance 1 is formed of a housing 2, a handle 3 including a trigger lever 4, and two thrust rods 5 having thrust pieces 6 which act upon dispensing pistons (not shown) in the cylinders of double cartridge 7. Said double cartridge 7 contains two components in a determined ratio which are mixed in a so-called static mixer during the dispensing operation, whereupon they react chemically and solidify. Dispensing of the two components from the cylinders is effected by simultaneous actuation of a respective dispensing piston which is disposed in each cylinder, whereby the substances are extruded through a front nozzle (not shown) of the static mixer. The double cartridge 7 itself is not an object of the present invention and has been described in detail e.g. in European Patent Application EP-A-294 672 in the name of the applicant. However, the electric dispensing appliance of the invention is not limited to the actuation of such double cartridges but is also suitable for single or multiple cartridges.

In dispensing appliances of this kind, as precise a proportioning as possible is desired while observing the exact mixing ratio of the dispensed substances. Regardless of the requirements of the advance system, which in the case of an electric drive are met as described below, it is detrimental for the precision that a part of the dispensed composition keeps flowing out, due to the structure of the cartridge, after the advance of the thrust rod has been stopped. It would be obvious in the case of an electrically operated motor to control the afterflow by electric, respectively electronic means by commutating the electric drive in order to retract the thrust rods. In practice, however, i.e. in order to provide a particularly simple and economical appliance, this cannot be achieved by simple means since it takes too much time for a simple electric drive to be commutated in order to retract the thrust rods. Simple mechanical means for retracting the thrust rods and thereby relieving the dispensing pistons in the cartridge are described herebelow.

Figure 3:
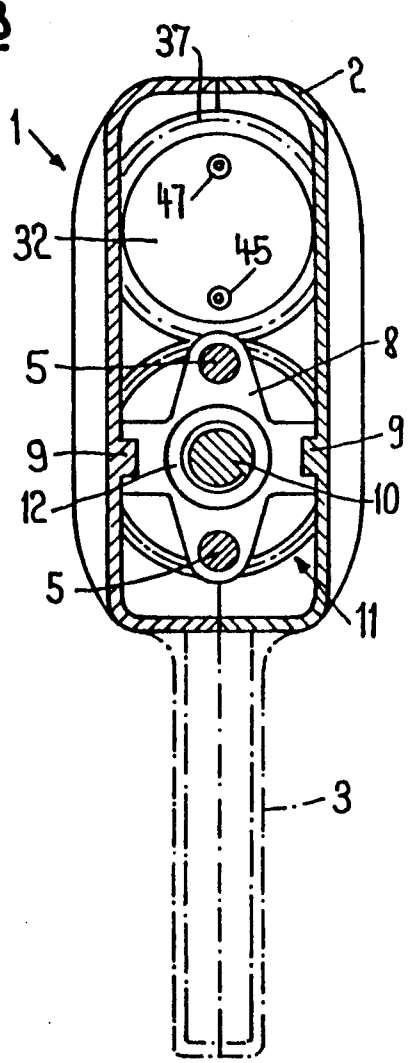
FIG. 3 shows a sectional view according to line III—III in FIG. 1.

Thrust rods 5 are advanced by a slide 8 running in guideways 9 which are integrally formed on the inner walls of the housing, see FIG. 3. These guideways provide an effective protection against any tilting of the thrust rods and of the spindle due to different reaction forces in the case of different cartridge diameters. Said slide is moved by a driving spindle 10 which is driven by a gear 11 to be described below. Spindle 10 runs in a corresponding threaded bushing 12 of said slide. Instead of journalling the spindle in a fixed bearing of the housing on the side of the cartridges, according to the invention, the driving spindle is held in the housing in a longitudinally displaceable manner, namely by a connecting piece 13 one end 14 of which is fitted in the housing and the other end of which forms a peg 15. Spindle 10 is provided on this side with a corresponding hole 16 and is attached to said connecting piece in a rotatable but not longitudinally displaceable manner by means of said peg.

Figure 4:
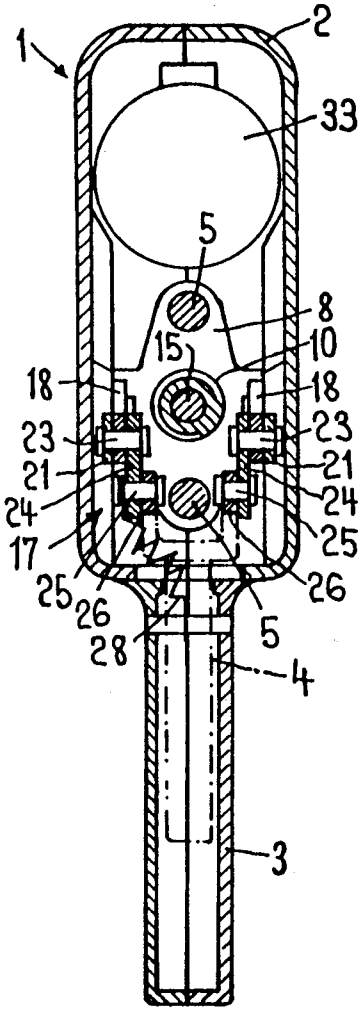
FIG. 4 shows a sectional view according to line IV—IV in FIG. 1.

The relatively small longitudinal displacement of the driving spindle with respect to the housing of some millimeters and thus of the thrust rods which are connected by the slide is effected by mechanical means, in the present case by a double toggle lever 17, see FIGS. 2 and 4, only one of the two levers being described here. The first lever 18 is hinged on pivot 19, which is provided on a rib 20 in the housing interior, while the second lever 21 is hinged on pivot 22 provided on connecting piece 13. The inner ends of both levers 18 and 21 of equal length are pivotably connected by axle 23 to a third lever 24 which extends perpendicularly to a straight line through the two other pivot points. At its other end, said third lever 24 is pivotably connected by an axle 25 to the angled part 26 of trigger lever 4 which is hinged on axle 27. Further connected to axle 25 is a tension spring 28 which is represented rather schematically in FIG. 4 and which may also have a different shape and position. In the situation of FIGS. 1 and 2, the toggle lever is in its idle position, return spring 29 acting upon the rear end 30 of the driving spindle so as to retract the latter and thus also the thrust rods 5. When the toggle lever is actuated by trigger lever 4, and since the first lever 18 is attached to the housing, connecting piece 13 is moved by the second lever to the left, i.e. in the direction of the cartridge, against the pressure of return spring 29, and a fixed connection between the driving spindle and the connecting piece, respectively the housing, is established. Meanwhile, the operating switch 31 of the electric drive is actuated by the trigger lever. As the trigger lever is released, the electric drive is either stopped or commutated, and the toggle lever is returned from its fixed position to the position shown in FIG. 2 with the help of tension spring 28 within a very short time. The connecting piece is thereby retracted under the action of return spring 29, and the driving spindle and the thrust rods which are connected thereto are retracted very quickly. The dispensing pistons are relieved by this brief recoil of the thrust rods including the thrust pieces, and an afterflow of the dispensed composition is immediately suppressed. It is useful to provide a damping for the end position of the trigger lever, e.g. by hydraulic means, or spring means 50 in order to prevent an unpleasant rebound. In the latter case the said hydraulic means can be used for assisting the forward motion of the trigger lever 4, using a known per se valve system.

The mechanical means for relieving the dispensing pistons do not necessarily have to be double toggle levers; they could also be shaped as eccentric levers, for example.

The appliance is driven by an electric motor 32 which provides e.g. a speed of 10,000 revolutions per minute. In the present example, the motor is supplied by an accumulator 33 which is recharged by a battery charger through openings 34. Further illustrated in FIG. 3 are the two electric connections 47 and 45 between the accumulator and the electric motor. Of course, the accumulator might also be exchanged or replaced with corresponding batteries through an appropriate opening 35 of the housing. Alternatively, a power supply for direct connection to mains can be built in.

Flanged to the motor is a reduction gear 36 having a reduction ratio of e.g. 70:1. Said reduction gear 36 is connected to a first gearwheel 37 which is adapted to mesh with a retracting gearwheel 44 if it is engaged accordingly. Said first gearwheel 37 is connected to a second reduction gear having a reduction ratio of e.g. 10:1 and the latter is in turn connected to a second gearwheel 40 which is adapted to mesh with an advancing gearwheel 41 if it is engaged by friction clutch 42, this arrangement resulting in a total reduction ratio of 700:1 and in a ratio between retraction and advance of 10:1, which means that the retraction of the thrust rods is effected ten times faster than their advance. Both the first and the second gearwheel may be provided with a respective slip clutch 43 in order to limit the torque, respectively the dispensing pressure.

If the electric drive is merely stopped when the trigger lever is released, the entire pressure upon the spindle subsists after the momentary relief, and the trigger lever must be pulled to overcome this pressure in order to actuate operating switch 31. Therefore, in the preferred embodiment, the electric motor is stopped after releasing the trigger lever and commutated for a short time, e.g. a for a third of a turn, whereby the spindle is moved backward. In order to obtain a fast retraction, means are connected to the toggle lever in order to bring the double-action friction clutch 42 to the retracting position immediately, so that the first gearwheel 37 is in meshing engagement with retracting gearwheel 44.

The individual gears and reduction gears as well as the friction and slip clutches are known components and can be freely adapted to the motor speed, which may be designed for different values, of course, and also to the desired precision and advancing speed. Instead of the two-sided friction clutch 42, which is brought to the advancing or the retracting position by a schematically represented switching knob 46, other clutches are conceivable, such as claw clutches or similar known clutches.

What I claim is:

1. An electrically operated dispensing appliance including at least one cartridge containing a composition to be dispensed, comprising:

a housing;

a driving spindle, having first and second ends, movable in an axial direction in the housing;

at least one thrust rod movable along and driven by said driving spindle;

electric drive means disposed in the housing for driving said driving spindle and thrust rod, the electric drive means including an operating switch;

mechanical means associated with said driving spindle for retracting said driving spindle and said at least one thrust rod, the mechanical means including a plurality of levers; and a trigger lever connected to said mechanical means, wherein when said trigger lever is released said mechanical means axially retracts said at least one thrust rod and said driving spindle, and said operating switch is actuated by said trigger lever to stop the electric drive means, to immediately suppress any afterflow of the dispensed composition.

2. The dispensing appliance of claim 1, further comprising a connecting piece having opposed ends, one end being rotatably attached to the first end of said driving spindle and the other end of said connecting piece being longitudinally, displaceable with the housing.

3. The dispensing appliance of claim 2, wherein each of said plurality of levers having opposed ends, a first lever being hinged at one end to an interior portion of the housing, a second lever being hinged at one end to said connecting piece, and a third lever being pivotally connected at one end to the other ends of both the first and second levers, the other end of said third lever being pivotally connected to said trigger lever.

4. The dispensing appliance of claim 3, wherein said third lever and said trigger lever are connected along an axle, with a tension spring attached to said axle.

5. The dispensing appliance of claim 1, further comprising a return spring attached to the second end of said driving spindle.

6. The dispensing appliance of claim 1, wherein said electric drive means comprises an electric motor, a pair of reduction gears in communication with the motor, a first pair of gearwheels coaxial with the pair of reduction gears, a second pair of gearwheels disposed on said driving spindle engaged to mesh with said first pair of gearwheels, a double-action friction clutch disposed on said driving spindle between the gearwheels of said second pair and a reversing switch for actuating said double-action friction clutch to obtain a greater speed during retraction of said driving spindle and at least one thrust rod.

7. The dispensing appliance of claim 6, wherein said electric motor continues to operate for a short time after said trigger leer is released and wherein means are connected to said toggle lever for moving said double-action friction clutch to a retracted position immediately after said trigger lever is released.

8. The dispensing appliance of claim 6, wherein each of said first gearwheels includes a slip clutch for limiting torque and dispensing pressure.

9. The dispensing appliance of claim 6, wherein said electric motor is powered by a rechargeable accumulator disposed inside said housing.

10. The dispensing appliance of claim 1, wherein said at least one thrust rod is advanced by a slide slidably disposed on said driving spindle and which runs along guideways integrally formed on both side of inner walls of said housing.

11. The dispensing appliance of claim 1, wherein said cartridge comprises a double dispensing cartridge for two-component compositions and includes at least two thrust rods, and wherein said mechanical means include two toggle levers which are disposed on both sides of said driving spindle.

12. The dispensing appliance of claim 1, further comprising damping means disposed between the trigger lever and housing for assisting the forward motion of the trigger lever.

13. The dispensing appliance of claim 12, wherein said damping means comprises a spring.

* * * * *